US005617086A

United States Patent [19]

Klashinsky et al.

[11] Patent Number: 5,617,086

[45] Date of Patent: Apr. 1, 1997

[54] TRAFFIC MONITORING SYSTEM

[75] Inventors: Rod Klashinsky; Terry Bergan, both of Saskatoon, Canada

[73] Assignee: International Road Dynamics, Saskatoon, Canada

[21] Appl. No.: 332,552

[22] Filed: Oct. 31, 1994

[51] Int. Cl.[6] ..... G08G 1/08

[52] U.S. Cl. ..... 340/907; 340/436; 340/905; 340/917; 340/933; 340/936

[58] Field of Search ..... 340/933, 936, 340/937, 589, 904, 905, 916, 917, 919, 907, 906, 928, 436, 438, 439, 914

[56] References Cited

U.S. PATENT DOCUMENTS

| | | | |
|---|---|---|---|
| 3,275,984 | 9/1966 | Barker | 340/31 |
| 3,544,958 | 12/1970 | Carey et al. | 340/31 |
| 3,680,043 | 7/1972 | Angeloni | 340/936 |
| 3,788,201 | 1/1974 | Abell | 340/937 |
| 3,835,945 | 9/1974 | Yamanaka et al. | 177/134 |
| 3,920,967 | 11/1975 | Martin et al. | 340/914 |
| 3,927,389 | 12/1975 | Neeloff | 340/38 |
| 3,983,531 | 9/1976 | Corrigan | 340/31 |
| 4,049,069 | 9/1977 | Tamamura et al. | 177/134 |
| 4,250,483 | 2/1981 | Rubner | 340/914 |
| 4,251,797 | 2/1981 | Bragas et al. | 340/905 |
| 4,284,971 | 8/1981 | Lowry et al. | 340/942 |
| 4,560,016 | 12/1985 | Ibanez et al. | 177/210 |
| 4,591,823 | 5/1986 | Horvat | 340/53 |
| 4,727,371 | 2/1988 | Wulkowicz | 340/917 |
| 4,750,129 | 6/1988 | Hengstmengel et al. | 340/917 |
| 4,793,429 | 12/1988 | Bratton et al. | 177/210 |
| 4,806,931 | 2/1989 | Nelson | 340/907 |
| 5,008,666 | 4/1991 | Gebert et al. | 340/936 |
| 5,109,224 | 4/1992 | Lundberg | 340/928 |
| 5,146,219 | 9/1992 | Zechnall | 340/905 |
| 5,173,672 | 12/1992 | Heine | 333/206 |
| 5,231,393 | 7/1993 | Strickland | 340/933 |
| 5,315,295 | 5/1994 | Fujii | 340/936 |

*Primary Examiner*—Jeffery Hofsass
*Assistant Examiner*—Davetta C. Woods
*Attorney, Agent, or Firm*—Nixon & Vanderhye P.C.

[57] ABSTRACT

A traffic monitoring system comprises a set of in-road sensor arrays for providing signals in response to a vehicle traversing the sensor arrays, a processor unit for processing the signals to determine vehicle speed and specific parameters such as axle count and spacing, and a traffic signal or sign controllable by the processor unit. The processor unit stores data specific to the site at which the traffic monitoring system is installed and uses the site-specific information and the specific parameters measured for the vehicle to determine whether or not to activate the traffic signal or sign. One embodiment is located before a steep downgrade and computes a safe descent speed for a vehicle to descend the downgrade and displays the safe speed on a roadside sign. Another embodiment is located before a curve, such as a highway exit ramp, and uses data such as ramp curvature and superelevation, together with vehicle height and class information to predict whether or not the vehicle will exceed a threshold speed for that vehicle to negotiate that curve without rollover. A third embodiment is located on a steep downgrade approaching a traffic signal controlled intersection and computes whether or not the vehicle is a "runaway" which cannot stop at the intersection if necessary, in which case the system pre-empts the traffic signal to ensure that the vehicle has right or way through the intersection. A video system records vehicles which prompted pre-emption.

9 Claims, 12 Drawing Sheets

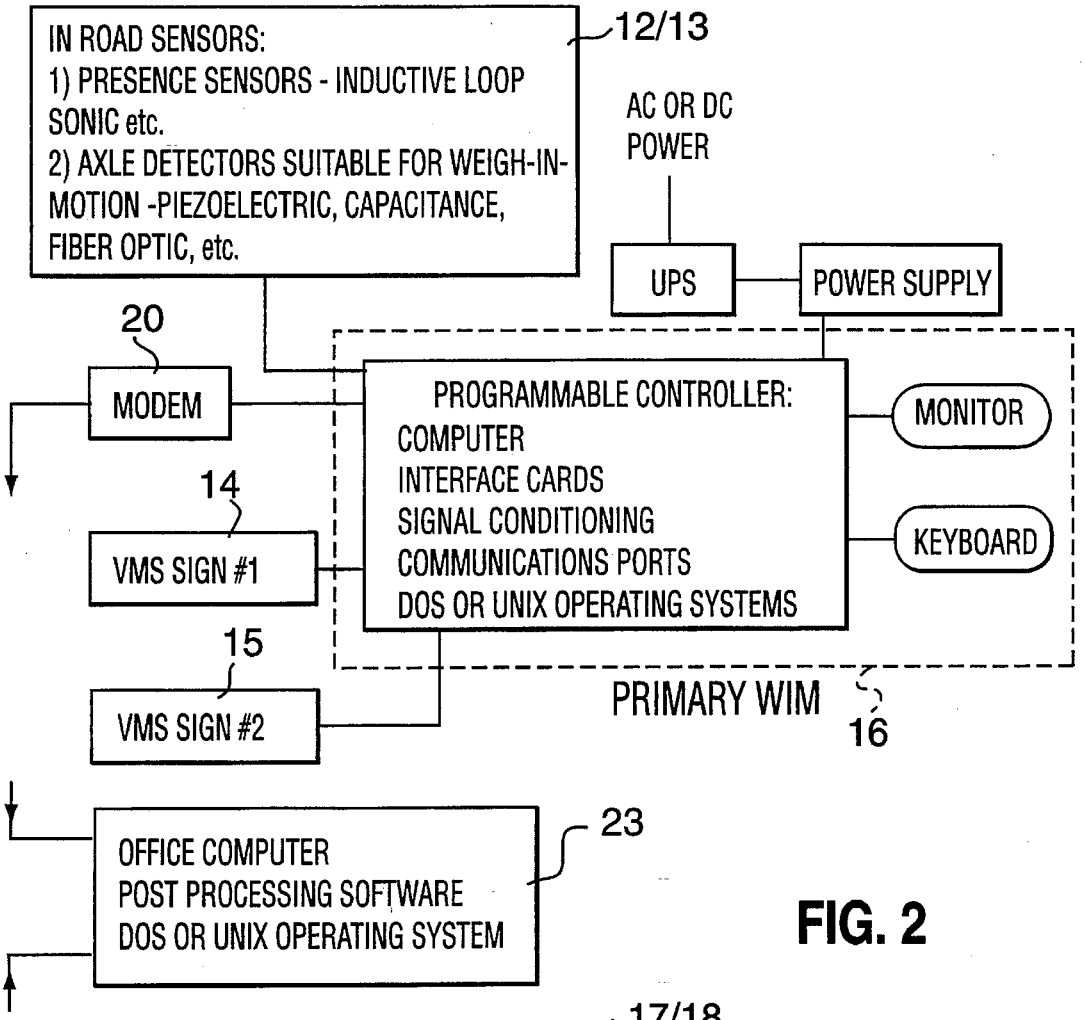
FIG. 2
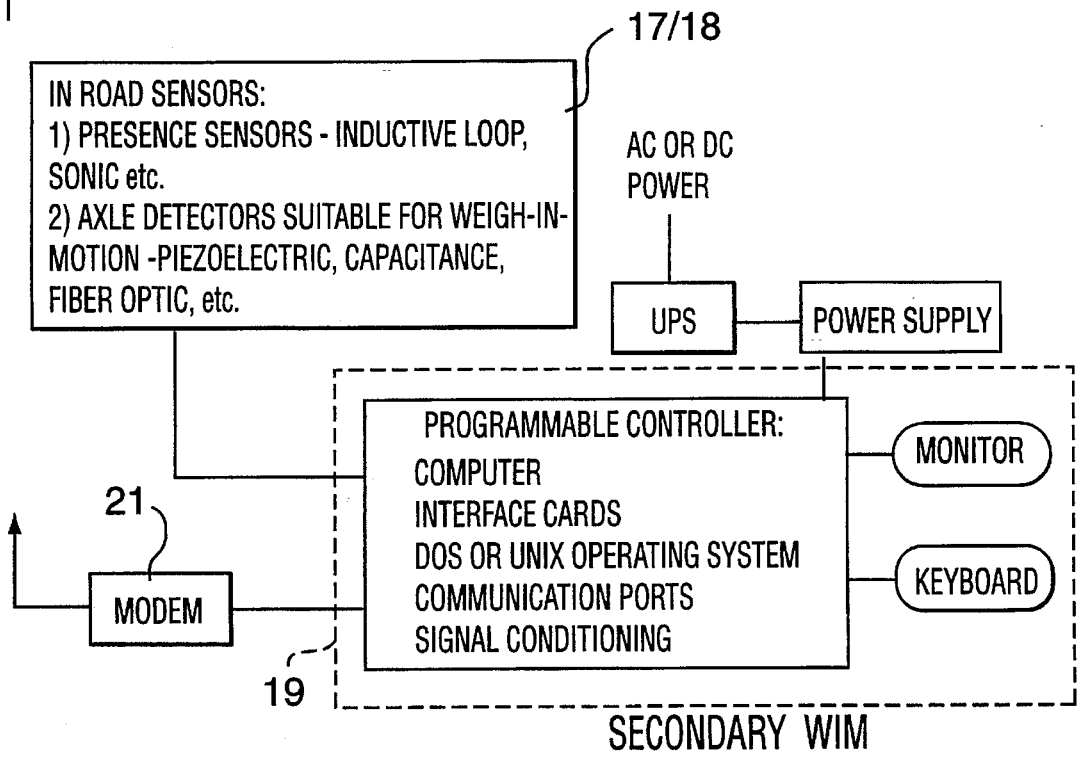

TRAFFIC MONITORING SYSTEM

TECHNICAL FIELD

The invention relates to traffic monitoring systems, and is especially applicable to systems for monitoring commercial vehicles.

BACKGROUND ART

Many kinds of systems have been disclosed which monitor and/or control traffic. Some simply operate regular traffic signals or warning signs U.S. Pat. No. 4,908,616 discloses a simple system deployed at a traffic signal controlled intersection. A warning device positioned in the approach to the intersection at a "reaction point" gives an indication to a driver as to whether or not his/her vehicle is too close to the intersection to stop safely if the traffic signal has just changed. The system does not measure vehicle speed and cannot account for differing stopping distances for different classes of vehicle.

Systems which measure the speed of the vehicle include that disclosed in U.S. Pat. No. 3,983,531 which measures the time taken for a vehicle to pass between two loop detectors and operates a visual or audible signal if the vehicle is exceeding a set speed limit. U.S. Pat. No. 3,544,958 discloses a system which measures the time taken for the vehicle to traverse the distance between two light beams and displays the measured vehicle speed on a warning sign ahead of the vehicle. Conversely, U.S. Pat. No. 3,275,984 discloses a system which detects when traffic is moving slowly, thereby indicating that a highway is becoming congested, and activates a sign near a highway exit to divert traffic via the exit. More recently, U.S. Pat. No. 4,591,823 disclosed a more complicated system using radio transceivers located along the roadway which broadcast speed limit signals by transceivers carried by passing vehicles. Signals returned by the vehicle mounted transceivers enable the roadside transceivers to detect speed violations and report them to a central processor via modem or radio.

Traffic monitoring systems have also been disclosed which monitor various parameters of the vehicle itself to enable the class of vehicle to be determined. Thus, U.S. Pat. No. 5,173,692 discloses a system for controlling access through a gate or entrance according to class of vehicle and which uses ultrasonic detectors to detect vehicle profiles and compare them with established profiles to determine the class of vehicle. U.S. Pat. No. 3,927,389 discloses a system which counts the number of axles on a vehicle to enable classification of the vehicle and calculation of an appropriate tariff for use of a toll road.

Systems are also known which use sensors to weigh vehicles while they are in motion so as to detect, for example, overweight commercial vehicles. Examples of such systems are disclosed in U.S. Pat. Nos. 3,835,945; 4,049,069; 4,560,016 and 4,793,429. U.S. Pat. No. 5,008,666 discloses traffic measurement equipment employing a pair of coaxial cables and a presence detector for providing measurements including vehicle count, vehicle length, vehicle time of arrival, vehicle speed, number of axles per vehicle, axle distance per vehicle, vehicle gap, headway and axle, weights.

The known systems do not, however, deal with the fact that a particular site will not be a hazard for one type of vehicle, for example a car, but will be a hazard for, say, a heavily-loaded truck. When commercial vehicles, especially large trucks, are involved in accidents, the results are often tragic. Statistics show that, although commercial vehicles are involved in a relatively small percentage of all motor vehicle accidents, they are involved in a higher percentage of fatal accidents than other vehicles. Consequently, they warrant special monitoring.

SUMMARY OF THE INVENTION

The present invention seeks to provide an improved traffic monitoring system which is especially suited to monitoring commercial vehicles.

According to the present invention, a traffic monitoring system comprises:

sensor means disposed in a traffic lane approaching a hazard for providing signals in dependence upon one or more parameters of a vehicle traversing the sensor means;

processor means having memory means storing site-specific data related to the hazard and the sensor means; and a traffic signal device associated with the traffic lane and disposed downstream of the sensor means, the traffic signal device being controlled by the processor means;

the processor means being responsive to signals from the sensor means for computing a vehicle speed, deriving from the site-specific data a maximum speed for the vehicle to negotiate the hazard, comparing the computed vehicle speed with the maximum vehicle speed and operating the traffic signal if the computed vehicle speed exceeds the maximum vehicle speed.

In one embodiment of the invention, a traffic monitoring system for determining potential rollover of a vehicle, the sensor means comprises a set of sensor arrays disposed in a traffic lane approaching a curve and a vehicle height sensor; the site-specific data comprises characteristics of the curve, such as superelevation and curvature; the traffic signal device comprises a variable message sign associated with the traffic lane and disposed between the sensor means and the curve; and the processor means is responsive to the signals from the sensor means for computing as the vehicle speed, a predicted speed at which the vehicle will be travelling on arrival at the curve, and derives the maximum speed for the particular vehicle to negotiate the curve safely on the basis of vehicle parameters including height, compares the predicted speed with the maximum speed and operates the traffic signal to display a warning to the driver of the vehicle if the predicted speed exceeds the maximum speed.

Such a system could be deployed at the beginning of an exit road from a highway, between the highway exit and a curved exit ramp, and warn the driver of a tall vehicle travelling so quickly that there is a risk of rollover as it attempts to negotiate the curve.

In another embodiment of the invention, a traffic monitoring system for detecting "runaway" vehicles, the sensor means comprises first, second and third sensor arrays spaced apart along a traffic lane upstream of a traffic signal controlled intersection having a set of traffic signals and a traffic signal controller. The sensor arrays each comprise sensors for providing signals in dependence upon one or more parameters of the vehicle. The site-specific data includes distances between the first and second sensor arrays and between the third sensor array and the intersection, and the processor is responsive to the site-specific data and signals from the first and second sensors for computing a maximum safe speed for the vehicle and responsive to the signals from the third sensor array for determining vehicle speed at the third sensor. The processor means compares the speed at the third sensor with the computed maximum safe speed and, if the third sensor speed exceeds the maximum safe speed, transmits a signal to the traffic signal controller causing the traffic signal controller to switch or maintain the traffic signal to afford right-of-way through the intersection to the vehicle.

This embodiment of the invention may be used to assess the danger of a heavily-laden truck descending a steep downgrade being unable to stop at a traffic controlled intersection. For one reason or another, a truck may be travelling too quickly to stop safely if the traffic signals are against it. Drivers of vehicles crossing the intersection with the traffic signals in their favour would be unaware of the risk of collision.

The traffic monitoring system may further comprise a video device, for example a camera, for capturing an image of a vehicle which has prompted pre-emption of the traffic signal.

In yet another embodiment of the invention, the sensor means comprises a plurality of sensors spaced apart prior to a downgrade, and the traffic signal device comprises a message sign positioned between the sensor means and the downgrade. The site-specific data includes the length and severity of the downgrade. The processor computes, from the sensor signals and the site-specific data, a maximum speed for the detected vehicle to descend the downgrade, and transmits a corresponding control signal to the message sign causing the message sign to display the maximum speed for a period of time during which the sign is visible to the driver of the vehicle.

Various objects, features, aspects and advantages of the present invention will become more apparent from the following derailed description, taken in conjunction with the accompanying drawings, of preferred embodiments of the invention.

BRIEF DESCRIPTION OF THE DRAWINGS

FIG. 2 is a block schematic diagram of the system of FIG. 1;

DESCRIPTION OF PREFERRED EMBODIMENTS

Downhill Speed Warning System

A first embodiment of the invention will now be described with reference to FIGS. 1 through 5. This first embodiment comprises a downhill speed warning system which is installed at the approach to a long, steep downhill grade, perhaps at the summit of a mountain pass. The system comprises sensor means and a programmable controller for weighing and classifying commercial vehicles, i.e. trucks, whilst they are in motion. Using that information and stored information specific to the downgrade, the system provides real-time safe descent speed calculations, and advises drivers of the safe descent speed by variable message signs—all before the vehicle begins to descend the downgrade.

Figure 1:
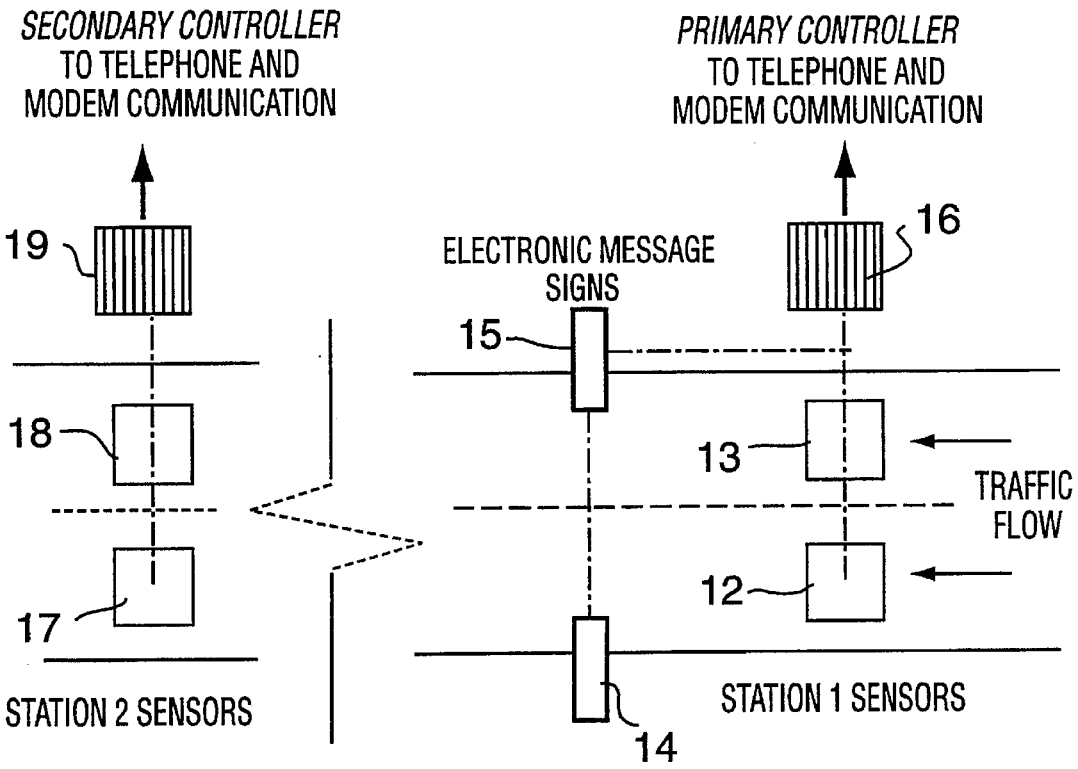
FIG. 1 illustrates a first embodiment of the invention comprising a traffic monitoring system installed upstream of a steep, potentially hazardous downgrade for advising a driver of a detected vehicle a safe descent speed for the vehicle.

Referring to FIGS. 1 and 2, the system comprises, at a first sensor station, a first pair of sensor arrays 12 and 13 embedded in a roadway surface in the left-hand and right-hand traffic lanes, respectively. The sensor arrays 12 and 13 each comprise a vehicle presence detector and sensors for providing signals in dependence upon number of axles and weight. THe sensor arrays 12 and 13 may comprise piezoelectric Class 1 sensors and inductive loop presence detectors. While these are preferred, suitable alternative sensors and detectors could be used, such as those disclosed in the patents cited in the introduction of this specification, and which are incorporated herein by reference.

On-scale detectors are incorporated into each lane adjacent each of the sensor arrays 12 and 13. The on-scale detectors ensure that the vehicles passing over the inroad sensor array 12 or 13 are fully within the active weighing zone of the sensor and are not straddling a lane. The on-scale detectors effectively eliminate the possibility that a vehicle which was improperly weighed will receive a message recommending a speed that is higher than is safe for that particular vehicle.

Without on-scale detectors, a vehicle straddling a lane could record a weight much lower than its actual weight, perhaps as little as one half of the actual weight. If this occurred, the safe speed calculation would be higher than it should be for that specific vehicle, resulting in a potentially dangerous situation. Therefore, on-scale detectors are important features of the downhill speed warning system.

A short distance downstream of the sensor arrays, two traffic signal devices, in the form of electronic variable message signs 14 and 15, are positioned adjacent respective left-hand and right-hand traffic lanes. The sensor arrays 12 and 13 and the electronic message signs 14 and 15 are connected to a first programmable roadside controller 16, conveniently located nearby. The programmable roadside controller 16 comprises a microcomputer equipped with interfaces for conditioning signals from the sensors, and an interface for transmitting a control signal to the message sign 14 or 15 for the lane in which the vehicle is travelling. The microcomputer is preprogrammed with site-specific software and data, i.e. specifically related to the location of the sensors and the characteristics of the downgrade, such as its length and severity, and vehicle classification data. It processes the signals from the sensor arrays and determines, for each vehicle, information including, but not limited to, number of axles on the vehicle, weight per axle, distance between axles, bumper-to-bumper vehicle length, gross vehicle weight (GVW), vehicle speed and lane of travel of the vehicle. It then determines vehicle class—based upon number of axles and their spacings. Using the site-specific information and the vehicle information, the microcomputer can compute an appropriate safe grade descent speed based on, inter alia, the weight of the vehicle and transmit a corresponding signal to the appropriate message sign 14 or 15 causing it to display the sate descent speed while the truck passes through the region in which the sign can be viewed by the driver of the vehicle. The duration of the message is based upon site specific geometrics and varies from site to site.

The microcomputer creates a vehicle record and stores it in memory, with the recommended safe descent speed, for subsequent analysis.

If the system cannot weigh the truck accurately, such as when a vehicle misses some of the sensors by changing lanes, the system will not display a recommended descent speed. In this case, the variable message sign will display a default message, such as "Drive Safely". The default message is user-programmable, allowing alternative messages to be substituted.

A second pair of WIM sensor arrays 17 and 18 are embedded in respective lanes of the roadway approximately one kilometre beyond the variable message signs 14 and 15. The second pair of sensor arrays 17 and 18 are similar to the first pair 12 and 13 and are coupled to a secondary roadside controller 19 to form a secondary sub-system. This secondary sub-system 17–19 collects the same information as the primary sub-system, but it is used only for monitoring the effectiveness of the primary system.

The roadside controllers 16 and 19 are equipped with modems 20 and 21, respectively, enabling remote retrieval of their vehicle record dam, via the telephone system, by a central computer 23 in a central operations building. Each controller 16, 19 may also have an interface or communications port enabling the vehicle records to be retrieved by, for example, a laptop computer. The system may also allow system operators to have full control over the primary WIM sub-system 12–16, including a disabling function and the ability to change the message on the variable message signs.

The remote computer also has data analysis software providing the ability to take two data files (one from the primary sub-system and another from the secondary sub-system) and perform an analysis on truck operators' compliance to the variable sign messages. Specific vehicle records from the two sub-systems can be matched, and reports can be generated on the effectiveness of the speed warning system.

Figure 3:
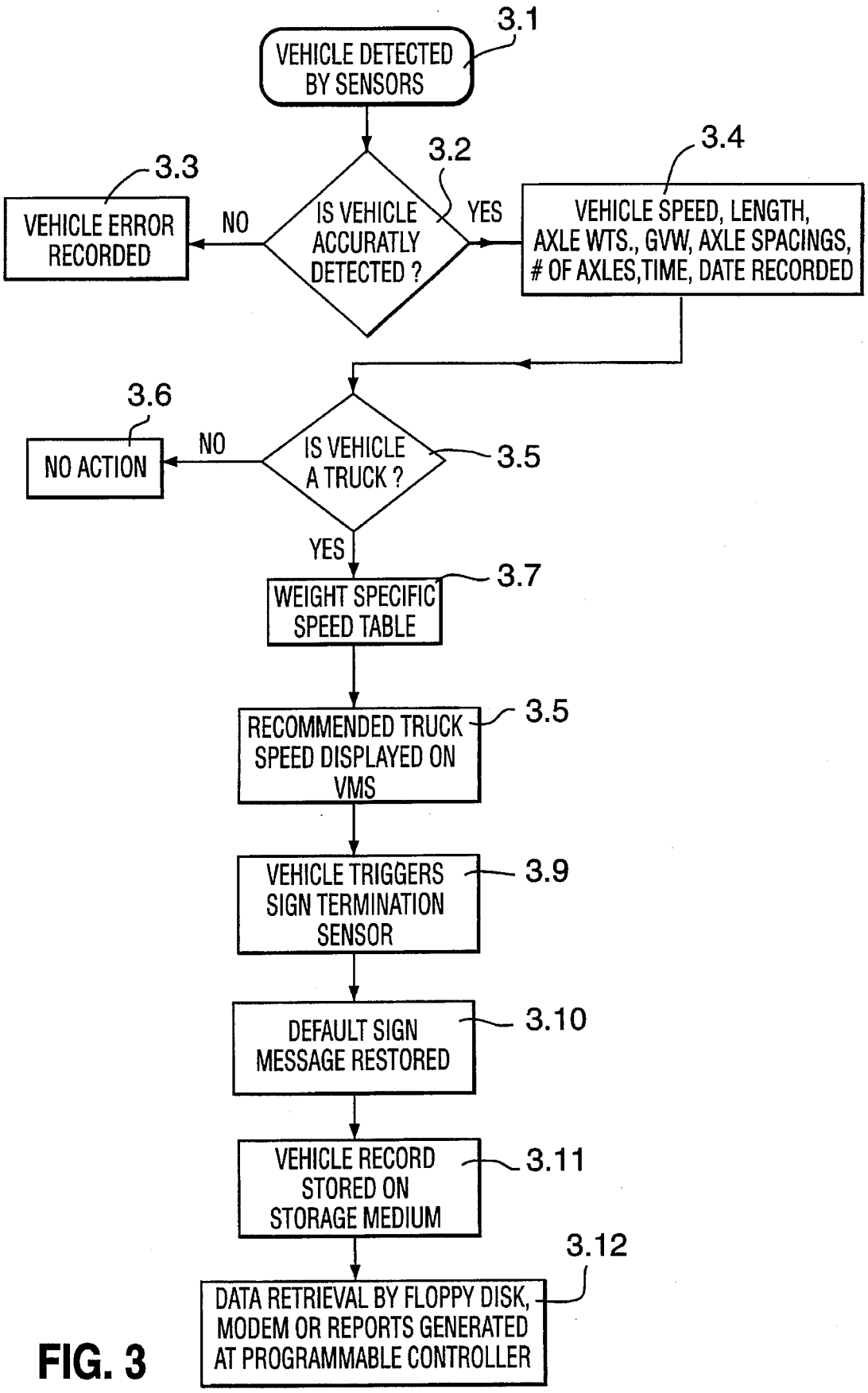
FIG. 3 is a flowchart depicting operation of a first processor unit of the system of FIG. 2.
Figure 4:
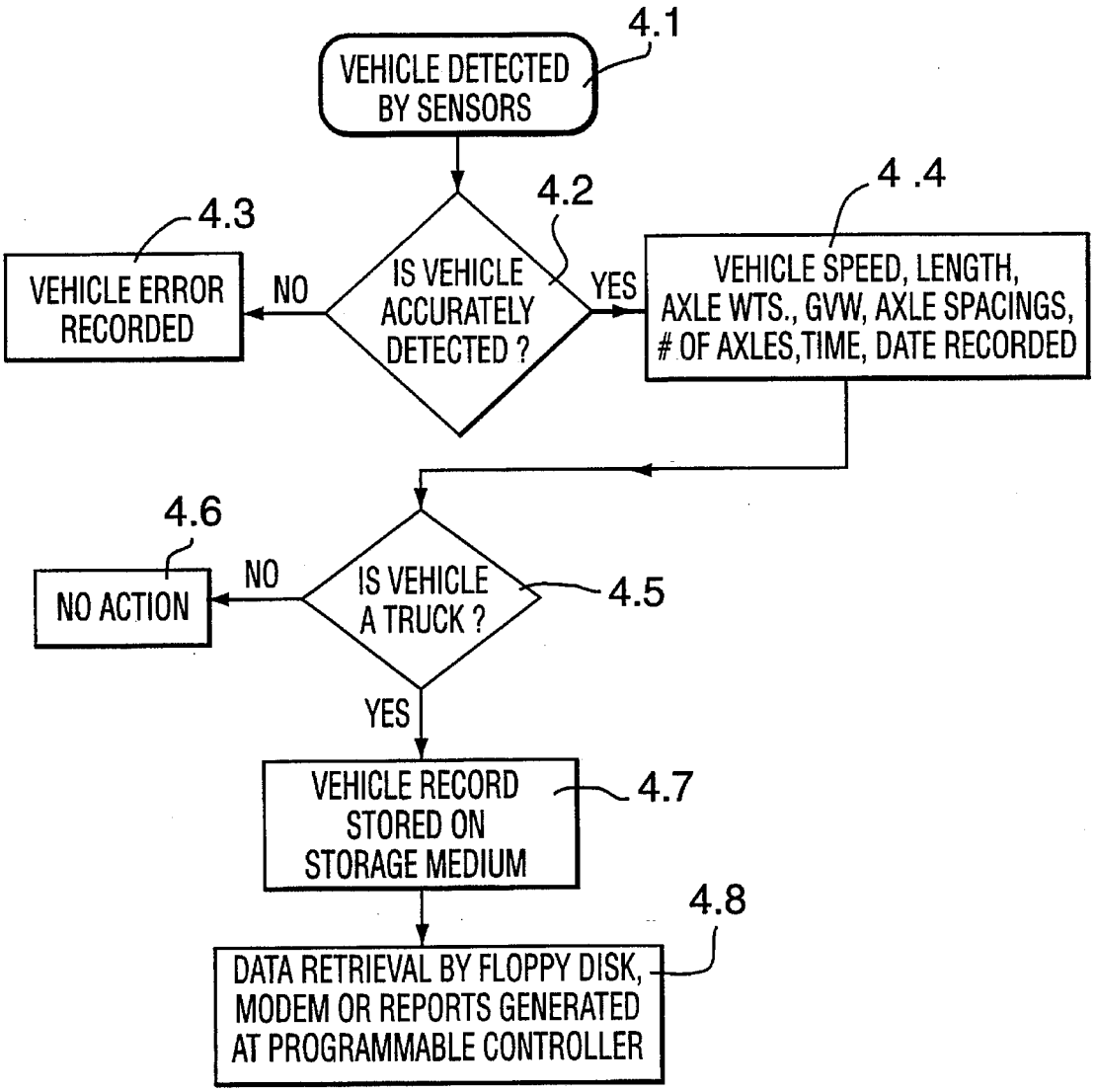
FIG. 4 is a flowchart depicting operation of a second processor unit of the system of FIG. 2.
Figure 5:
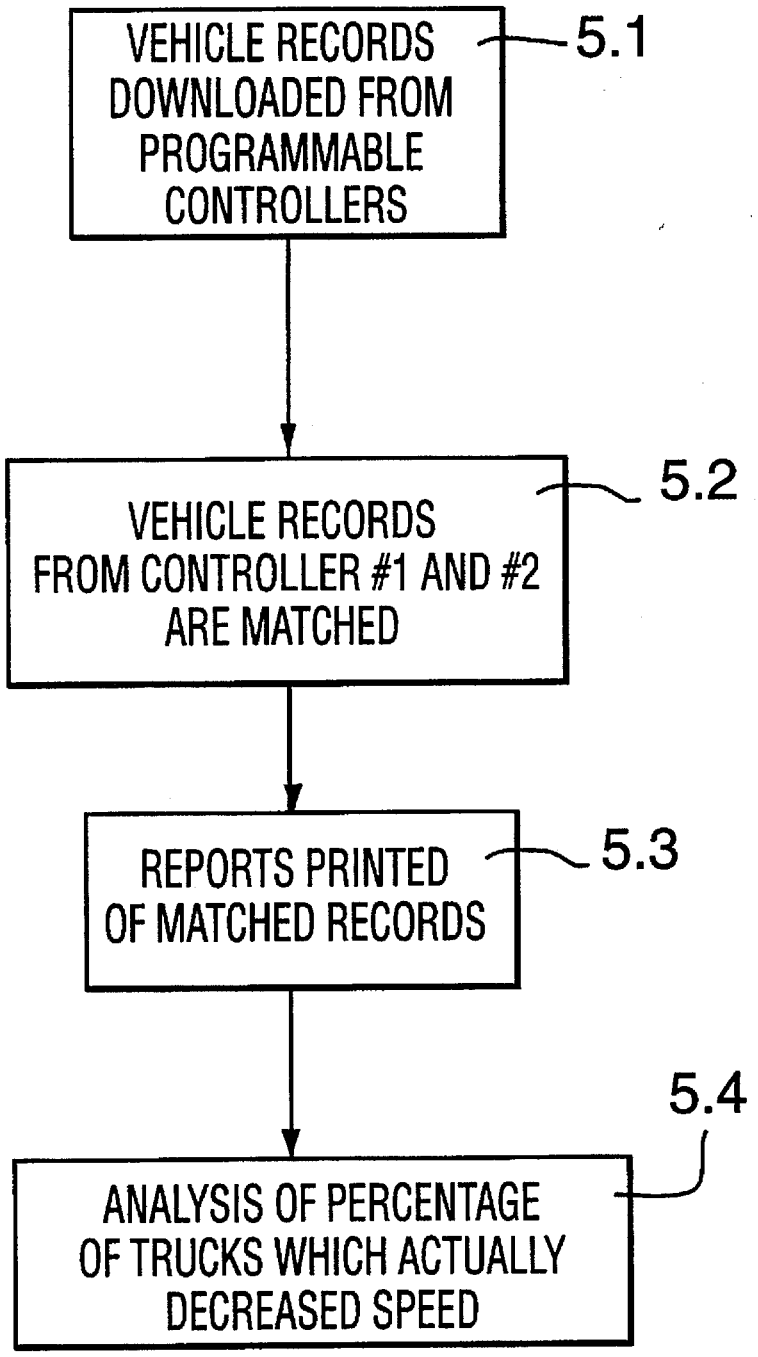
FIG. 5 is a flowchart depicting subsequent processing of vehicle records.

The sequence of operations as a vehicle is processed by the system is depicted in the flowcharts shown in FIGS. 3 and 4 and subsequent analysis in the flowchart of FIG. 5. For convenience of description, it will be assumed that the vehicle is in the left-hand lane. It will be appreciated, however, that the same process would apply to a vehicle in the other lane. Referring first to FIG. 3, which depicts operation of the primary roadside controller 16, when a vehicle passes over sensor array 12, the microcomputer receives a vehicle detection signal, step 3.1, and confirms in decision step 3.2 whether or not the vehicle has been detected accurately. If it has not, step 3.3 records an error. If the vehicle has been detected accurately, the microcomputer processes all of the signals from the sensor array 12, in step 3.4, to determine vehicle speed, length, weight per axle, gross vehicle weight (GVW), number of axles and axle spacings, and creates a vehicle record containing this information, together with the time and date. Comparing the information with vehicle classifications stored in its memory, the microcomputer determines in step 3.5 whether or not the vehicle is a truck. If it is not, no further action is taken, as indicated by step 3.6. If it is a truck, step 3.7 accesses a weight-specific speed table to determine, for that vehicle class and weight, a recommended safe speed for that vehicle to descend the downgrade. In step 3.8, the microcomputer conveys a corresponding signal to variable message sign 14 which displays the calculated safe grade descent speed for the specific vehicle, such as "30 KPH Max". The truck driver is expected to gear down so that the recommended speed is achieved with an engine speed that is as high as practical. Once the vehicle passes the variable message sign 14, steps 3.9 and 3.10 restore the variable message sign to the default message. The default restoration signal may be generated when the vehicle triggers a subsequent termination sensor (not shown), or a timer "times-out" after a suitable time-out interval. Step 3.11 stores the vehicle record, including the recommended speed, in memory for subsequent retrieval, as indicated by step 3.12, using a floppy disc, via modem, a laptop or any other suitable means of transferring the data to the central computer for subsequent analysis.

After descending at least part of the downgrade, the vehicle passes over one of the second set of sensor arrays, say sensor array 17, and the secondary roadside controller 19 receives a vehicle presence signal, as indicated in step 4.1 in FIG. 4. The secondary programmable roadside controller performs an abridged set of the operations carried out by the primary roadside controller 16. Thus, following receipt of the vehicle presence signal in step 4.1, it determines in step 4.2 whether or not the vehicle was accurately detected. If it was not, step 4.3 records an error. If it was, in step 4.4 the signals from the sensor array 17 are processed to produce a secondary vehicle record comprising vehicle speed, length, weight per axle, gross vehicle weight (GVW), number of axles and axle spacings, together with the time and date. Using this information, and vehicle classification data stored in memory, step 4.5 determines whether or not the vehicle is a truck. If it is not, no further action is taken, as indicated by step 4.6. If it is a truck, step 4.7 stores the vehicle record in memory. As in the case of the primary controller 16, the vehicle records can be downloaded to a floppy disc; a laptop computer connected via a suitable port; or via modem to the central computer, for subsequent analysis to determine the effectiveness of the system.

As illustrated in FIG. 5, which shows a flowchart for the analysis by the central computer, vehicle records downloaded in step 5.1 from both programmable controllers 16 and 19 are compared in step 5.2 to match each primary vehicle record from the primary controller 16 with a corresponding secondary vehicle record, i.e. for the same vehicle, from the secondary controller. The comparison is based on time, axle spacings and axle weight. A file is then created containing the primary vehicle record number from the primary controller 16, the vehicle secondary record number from the secondary controller 19, date, time and GVW from the primary controller, the vehicle's speed as measured by the primary controller, the recommended speed, and the vehicle's speed as measured by the secondary controller. Displaying or printing the matched records, as in step 5.3, enables a comparison to be made between the speed of the truck when it traversed the first sensor array 12 and its speed when it traversed the second sensor array 17. Step 5.4 determines the percentage of trucks which decreased speed as advised.

The Dynamic Downhill Truck Speed Warning System is not intended to replace runaway truck ramps, but to complement the ramps and potentially decrease the probability of required use of these ramps.

Rollover Warning System

Figure 6:
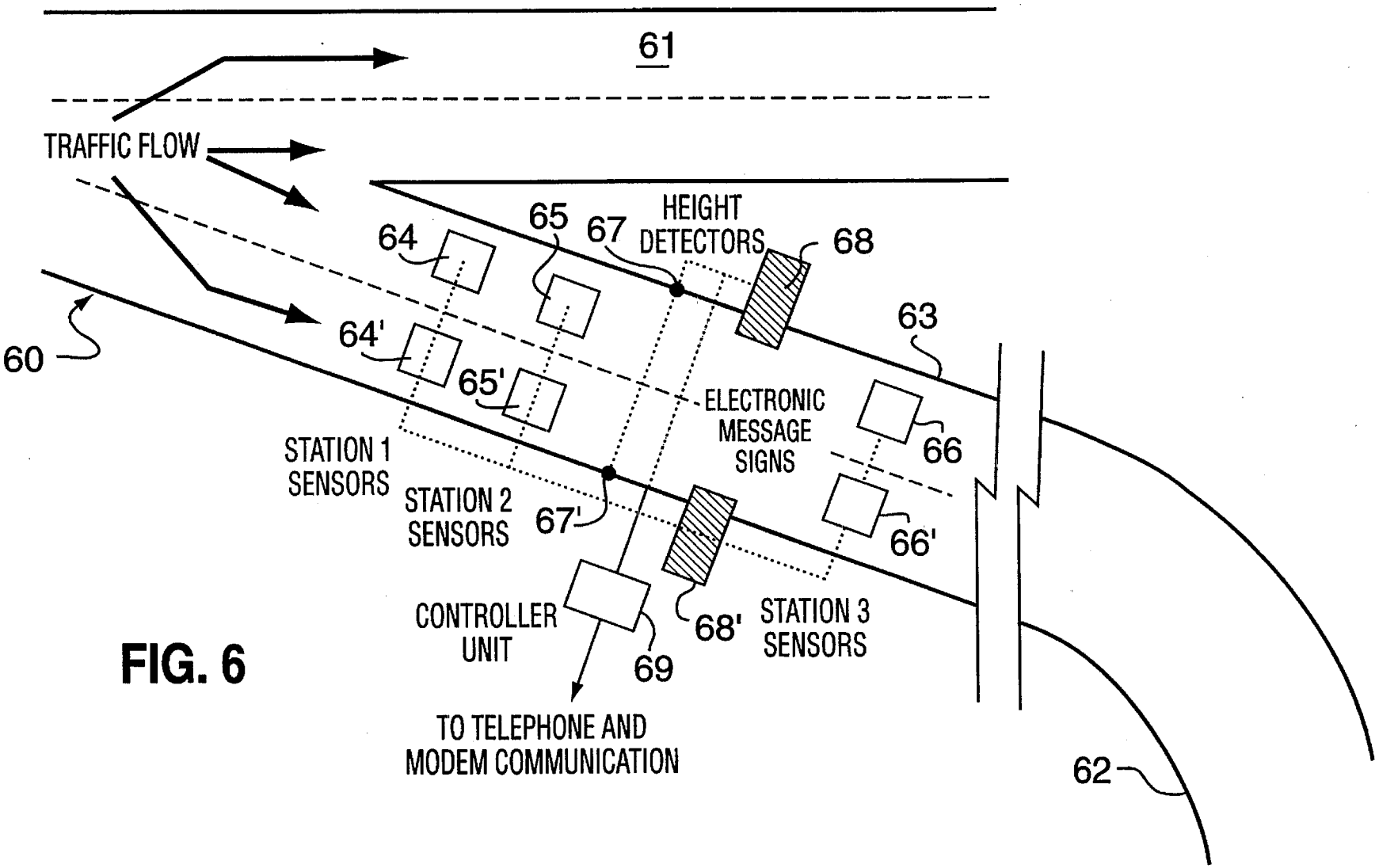
FIG. 6 illustrates a second embodiment of the invention comprising a vehicle monitoring system installed upstream of a curve, for monitoring for potential rollover of vehicles negotiating the curve.

A second embodiment of the invention, for detecting potential rollover of vehicles approaching a curve, will now be described with reference to FIGS. 6 through 8. FIG. 6 shows the components of a traffic monitoring system deployed between an exit 60 of a highway 61 and a curved ramp 62 of the exit road 63. The system comprises a first set of in-road sensor arrays 64, 65 and 66 spaced apart along the right hand lane of the exit road upstream of the curve 62. The first two sensor arrays 64 and 65 comprise weigh-in-motion (WIM) sensors and presence detectors, similar to those used in the first embodiment. The third sensor array 66, comprising a vehicle presence detector and axle sensor, is spaced downstream of the second sensor array 65. A height detector 67 is positioned alongside the right-hand lane and adjacent the second weigh-inmotion sensor array 65. The height detector 67 may comprise any suitable measuring device, such as a laser or other light beam measuring device. A traffic signal device, in the form of an electronic message sign 68, is disposed between the second and third sensor arrays 65 and 66 and associated with the right-hand traffic lane, for example above it or adjacent it. The exit mad has two lanes and a duplicate set of sensors 64'–67' and a traffic sign 68' are provided for the left hand lane. Since the operation is the same for both sets of sensors, only the set in the right-hand lane will be described further.

Figure 7:
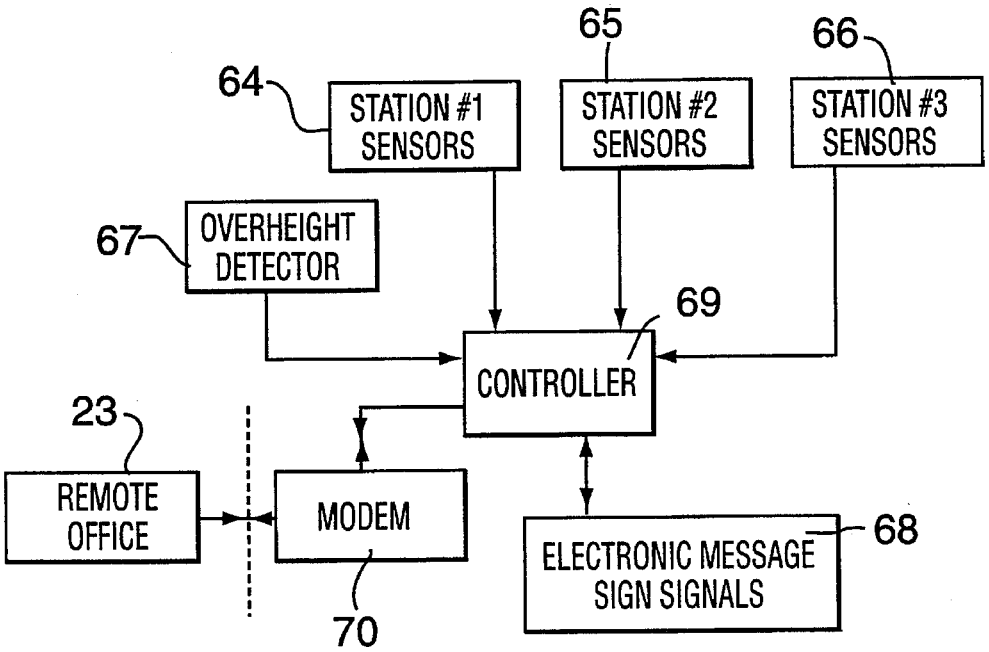
FIG. 7 is a simplified block schematic diagram of the system of FIG. 6.
Figure 8A:
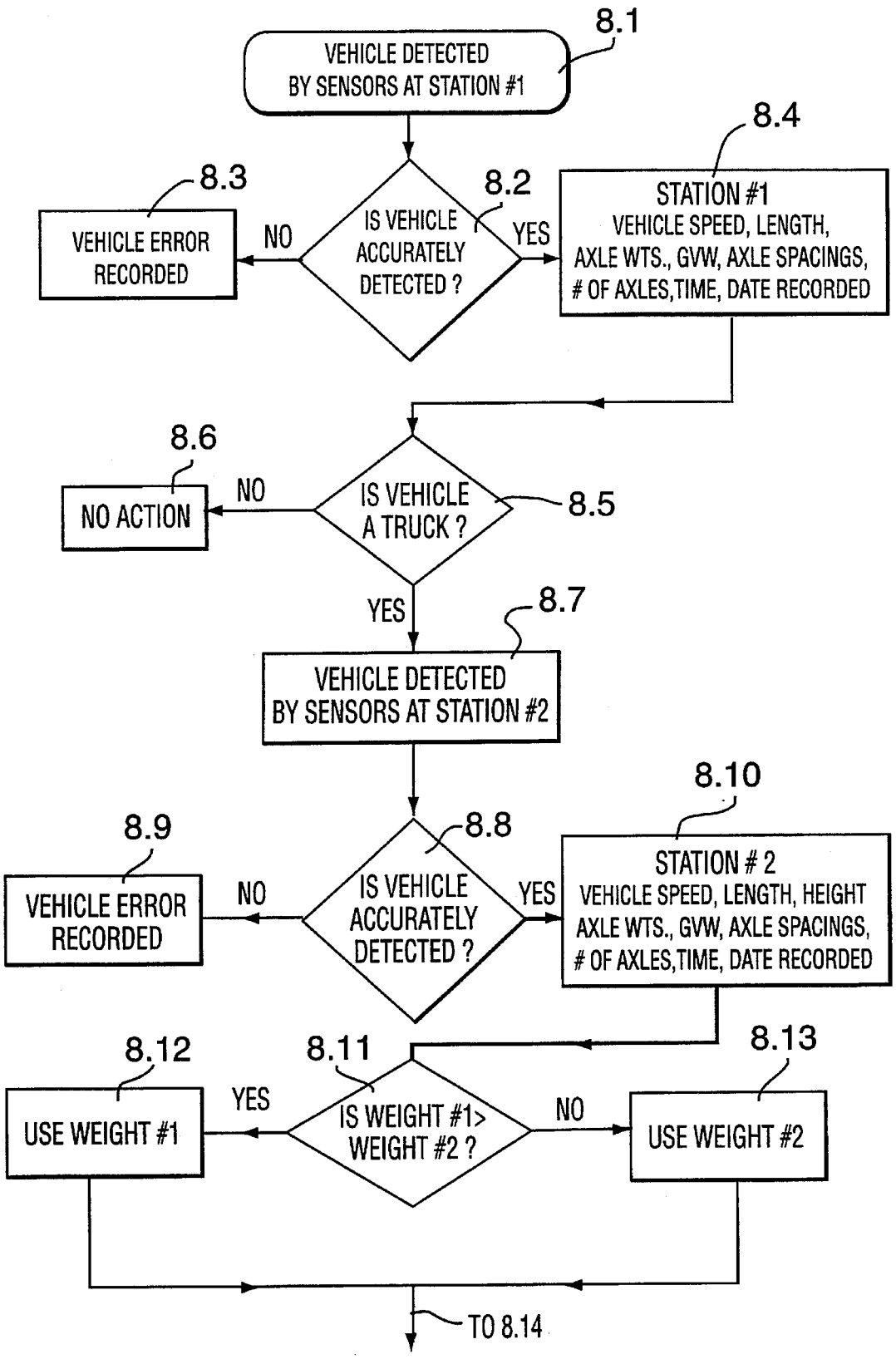
FIG. 8 is a flowchart depicting operation of the system of FIG. 6.
Figure 8B:
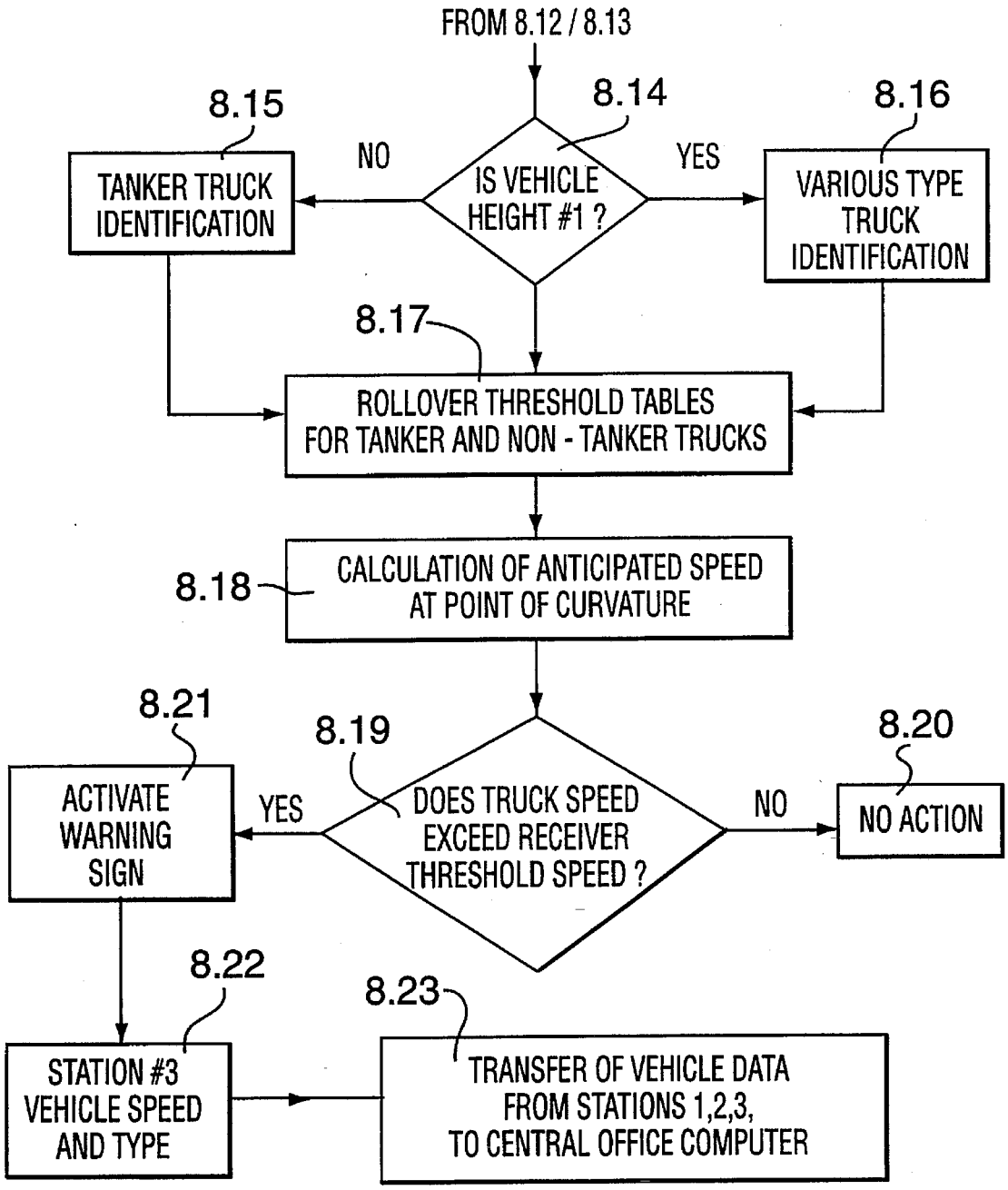

Referring also to FIG. 7, the sensors 64–67 and the electronic message sign 68 are connected to a roadside controller 69 which comprises the same basic components as the roadside controller of the first embodiment described above, including a microcomputer and a modem 70. The microcomputer contains software and data for processing the sensor signals to give vehicle axle and gross vehicle weights, vehicle class based on number of axle and axle spacings, and vehicle speed. The microcomputer is preprogrammed, upon installation, with data specific to the site, such as superelevation and radius of the curve, and the various distances between the sensor arrays and the curve. In use, the processor uses the site-specific data, and the vehicle-specific data derived from the sensor arrays 64 and 65, to compute deceleration between the sensor arrays and predict the speed at which the vehicle will be travelling when it arrives at the curve 62. Taking into account weight, height and class of the vehicle, and superelevation and radius of the curve, it determines a maximum safe speed at which that particular class of vehicle should attempt to negotiate the curve. If the predicted speed exceeds this maximum, implying a risk of rollover occurring, the processor activates the message sign to display a warning, such as SLOW DOWN! or some other suitable message. The sign is directional and is viewed only by the person in the passing truck. The threshold speed is programmable and can be input or changed by the system user.

The sequence of operations as a vehicle is processed by the system will now be described with reference to FIG. 8. When the vehicle passes over sensor 64, the resulting presence detection signal from the presence detector at sensor array 64 is received by the processor in step 8.1 and the processor determines in step 8.2 whether or not a vehicle has been accurately detected. If it has not, step 8.3 record an error. If it has been accurately detected, step 8.4 processes the signals from the sensor array 64 to determine vehicle speed, length, weight per axle, gross vehicle weight, axle spacings and number of axles. It uses the information, together with the time and date, to create a vehicle record and in decision step 8.5 compares the measurements with a table of vehicle classes to determine whether or not the vehicle is of a class listed, specifically a truck. If it is not, the processor takes no further action as indicated in step 8.6. If decision step 8.5 determines that the vehicle is a truck, however, the processor determines in steps 8.7 and 8.8 whether or not the vehicle was also accurately detected at second sensor array 65. If not, an error is recorded in step 8.9. If it is detected accurately, the processor processes the signals received from sensor 65 to compute, in step 8.10 the corresponding measurements as in step 8.4. In step 8.11, the processor compares the record from sensors 64 and 65 to determine which of the two weight measurements is the higher and uses that weight (steps 8.12, 8.13) for further processing. In step 8.14, the processor determines whether or not vehicle height is greater than a threshold value (shown as eleven feet in FIG. 8). If the vehicle height is greater than the threshold value, the processor proceeds to step 8.15 to identify it as tanker or truck.

If the height of the vehicle is less than the threshold value, step 8.16 identifies the truck type. Having identified the vehicle type in step 8.15 or step 8.16, the processor proceeds to access its stored Rollover Threshold Tables in step 8.17 to determine a threshold speed for that particular vehicle to safely negotiate the curve. In step 8.18, the processor uses the measured speeds at the first and second sensorarrays 64 and 65, and the distance between them, to determine the vehicle's deceleration and extrapolates to predict the speed of the vehicle when it arrives at the beginning of the curve 62. Step 8.19 compares the predicted speed with the rollover threshold speed. If it is lower, no action is taken, as indicated by step 8.20. If the predicted speed is higher than the rollover threshold speed, however, step 8.21 activates the message sign 68 for the required period to warn the driver of the vehicle to slow down.

Step 8.22 represents the sequence of steps by the processor to process the corresponding signals from sensor array 66 to ascertain vehicle speed and type and create a secondary record. Subsequent transmission of the vehicle data derived from all three sensor arrays 64–66 to a central computer, or retrieval in one of the various alternatives outlined above, is represented by step 8.23.

The third sensor array 66 is optional and is for system evaluation purl:loses. It is positioned between the electronic message sign 68 and the curve 62 and is used to monitor whether or not the message is heeded, i.e. whether or not vehicles are slowing down when instructed to do so by the message sign. The signals from its sensors are also supplied to the programmable controller. This third sensor array 66 need only supply information to enable vehicle classification and vehicle speed to be determined and so comprises a vehicle axle sensor and a vehicle presence detector which is activated when a vehicle enters its field. The controller 69 processes the signals from the third sensor array 66 to produce a secondary vehicle record. As before, data from the controller can be downloaded to a remote computer and vehicle records from the first and second sensor compared with the corresponding vehicle record from the third sensor to determine the speed of the vehicle before and after the message sign. This allows statistics to be accumulated showing the number of vehicles slowing down when instructed to do so by the sign, thereby allowing evaluation of system effectiveness.

The system algorithm is site specific to accommodate certain site characteristics. The software can be compiled on any site with a known super elevation and radius. The dam is stored on site in the programmable controller and is retrievable either by laptop computer on site or remotely via modem communication. The controller also has an auto-calibration feature. If the system fails for any reason, an alert signal is transmitted to the host computer via modem, informing the system operators of a system malfunction.

The programmable controller allows the system operator to adjust maximum allowable safe speeds, based on collected data on truck speeds at particular locations. For example, if the maximum safe speed is set at the posted speed limit, but the majority of trucks are exceeding the posted speed limit at a particular location, then the variable message warning sign would be excessively activated, and the system would lose its effectiveness. Therefore, it is desirable to adjust speed threshold parameters to increase system effectiveness. The center of gravity for each truck is estimated from the rollover threshold tables.

As an option to the main weighing and detection sensors, on-scale detectors may be incorporated into each lane to ensure that the vehicles passing over the in-road sensor array are fully within the active weighing zone of the system, and are not straddling a lane. The on-scale detectors effectively eliminate the possibility that a vehicle which was improperly weighed will receive a message for a speed that is higher than is safe for that particular vehicle.

The electronic message sign conveniently is installed directly below a traditional information sign (such as a "danger ahead" sign with the image of a truck rolling over) which indicates the ramp advisory speed. The message sign is not a continuous beacon which flashes continuously. Rather, it is a sign which is activated only when a truck is exceeding the rollover threshold speed at a particular curve. A message for a specific truck is more effective, since the sign is an exception to regular signing and not a common background feature.

Traffic Signal Pre-emption System

Figure 9:
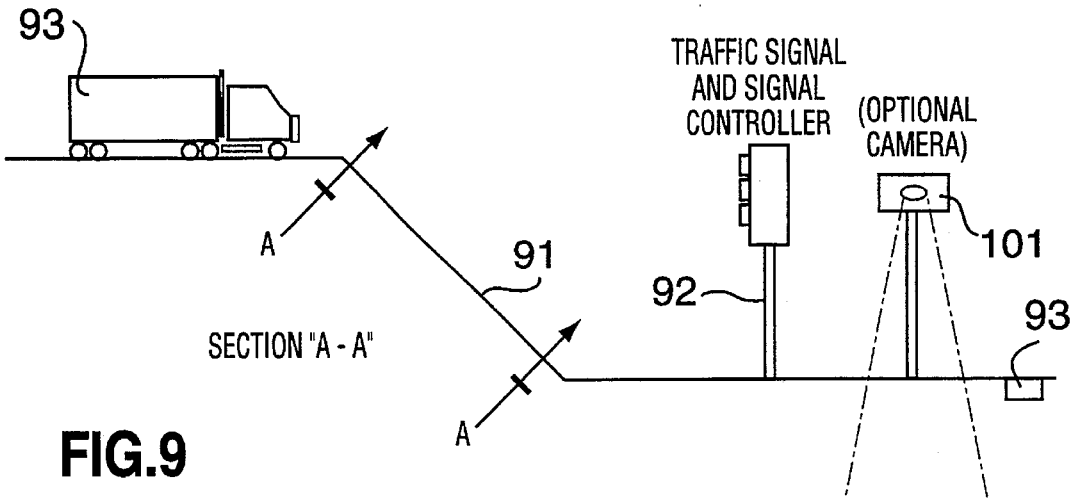
FIGS. 9 and 10 illustrate a third embodiment of the invention in the form of a traffic monitoring system installed upstream of a traffic signal controlled intersection and operable to pre-empt the traffic signals.
Figure 10:
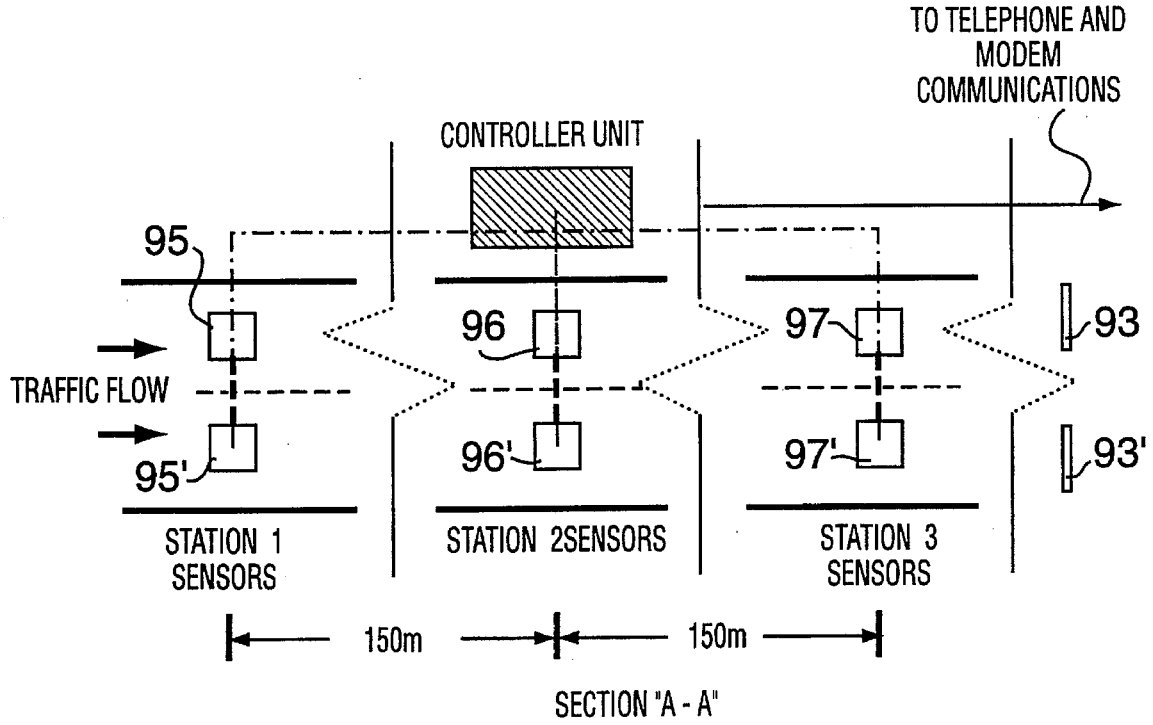
Figure 11:
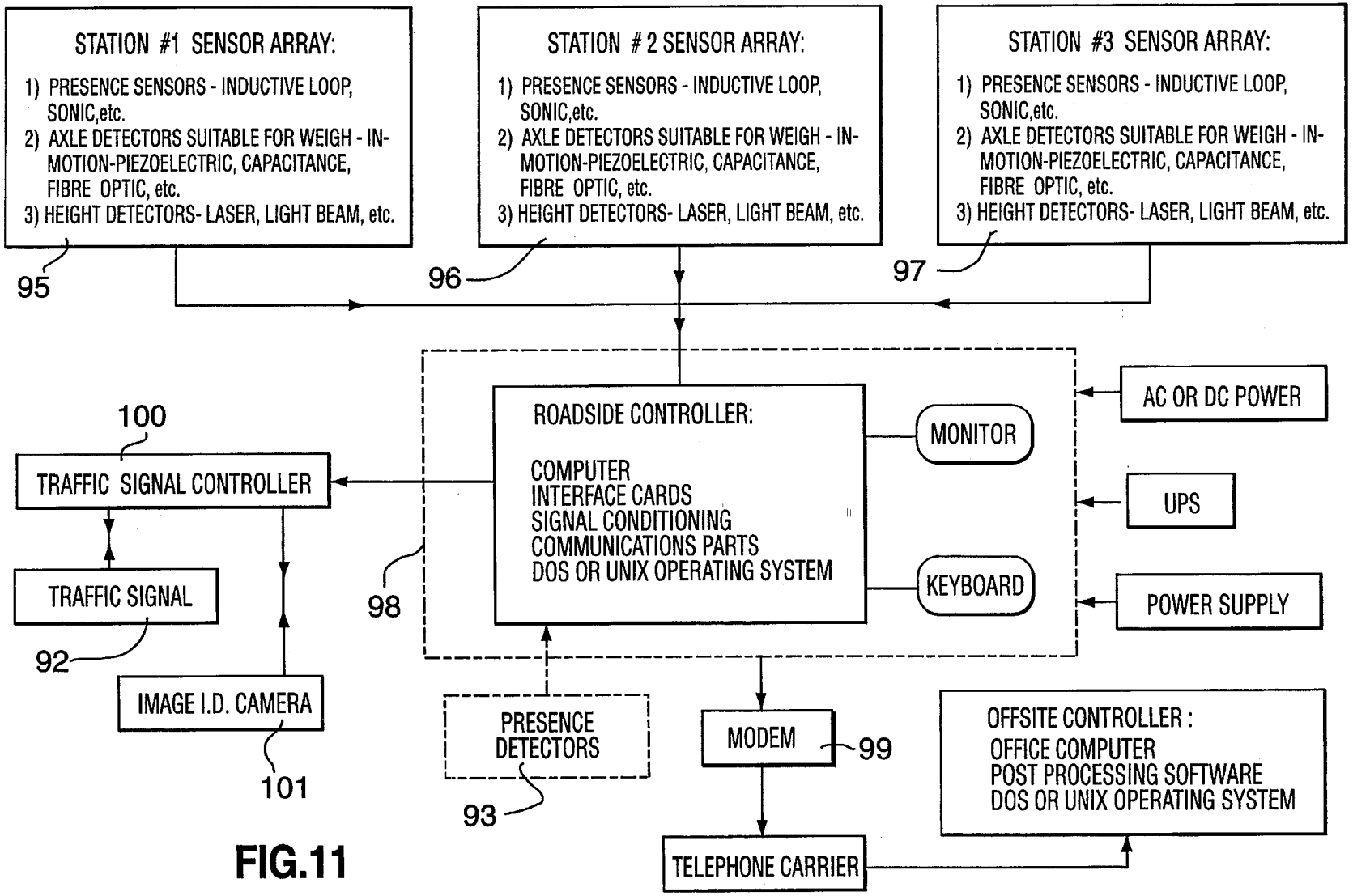
FIG. 11 is a simplified block schematic diagram of the system of FIGS. 9 and 10.

A third embodiment of the invention, specifically a traffic signal pre-emption system which monitors vehicle speed at successive points along a steep downgrade to determine when there is a "runaway" truck and pre-empts traffic signals along the runaway truck's path, will now be described with reference to FIGS. 9 through 12. FIG. 9 depicts a section through a steep downgrade 91 with an intersection at the bottom. The intersection is controlled by traffic signals 92 of conventional construction, i.e. the usual red, yellow and green lights controlled by a traffic signal controller (FIG. 11). A truck 93 is shown at the top of the downgrade. As the truck descends the downgrade, it will traverse a set of sensor arrays shown in more detail in FIG. 10. As in the other embodiments, a set of sensor arrays is provided for each traffic lane. Each set comprises three sensor arrays 95, 96 and 97 spaced apart in the road surface along the downgrade. The first two sensor arrays 95 and 96, each comprising a vehicle presence detector and weigh-in-motion sensors similar to those described previously, are spaced about 150 meters apart. The third sensor array 97 is positioned about 150 meters beyond the second sensor array 95 and comprises a vehicle presence detector and an axle sensor. The sensor arrays 95, 96 and 97 are connected to a roadside controller 98 similar to those of the other embodiments, including a processor and a modem 99. As shown in FIG. 11, the roadside controller is connected to traffic signal controller 100 which controls the sequence of the traffic signals 92 and also a camera 101 located adjacent the traffic signals.

As a vehicle traverses the sensor arrays, the processor determines the speed weight and vehicle type using the signals from the first sensor array 95. Using the preprogrammed site-specific data, including site characteristics such as length and severity of the downgrade, the processor computes a maximum speed for that particular class and weight of vehicle. From the signals from the second sensor array 96, the processor determines whether or not the vehicle is exceeding the calculated maximum speed and whether the speed of the vehicle has increased significantly, or decreased, between the first two sensor arrays 95 and 96. If the speed of the vehicle as it traverses the third sensor 97 is greater than the calculated maximum value, indicating that the vehicle cannot stop safely at the intersection, the processor transmits a pre-empt signal to the traffic signal controller 100 which ensures that the traffic signals are in favour of the vehicle when it arrives at the intersection.

Figure 12A:
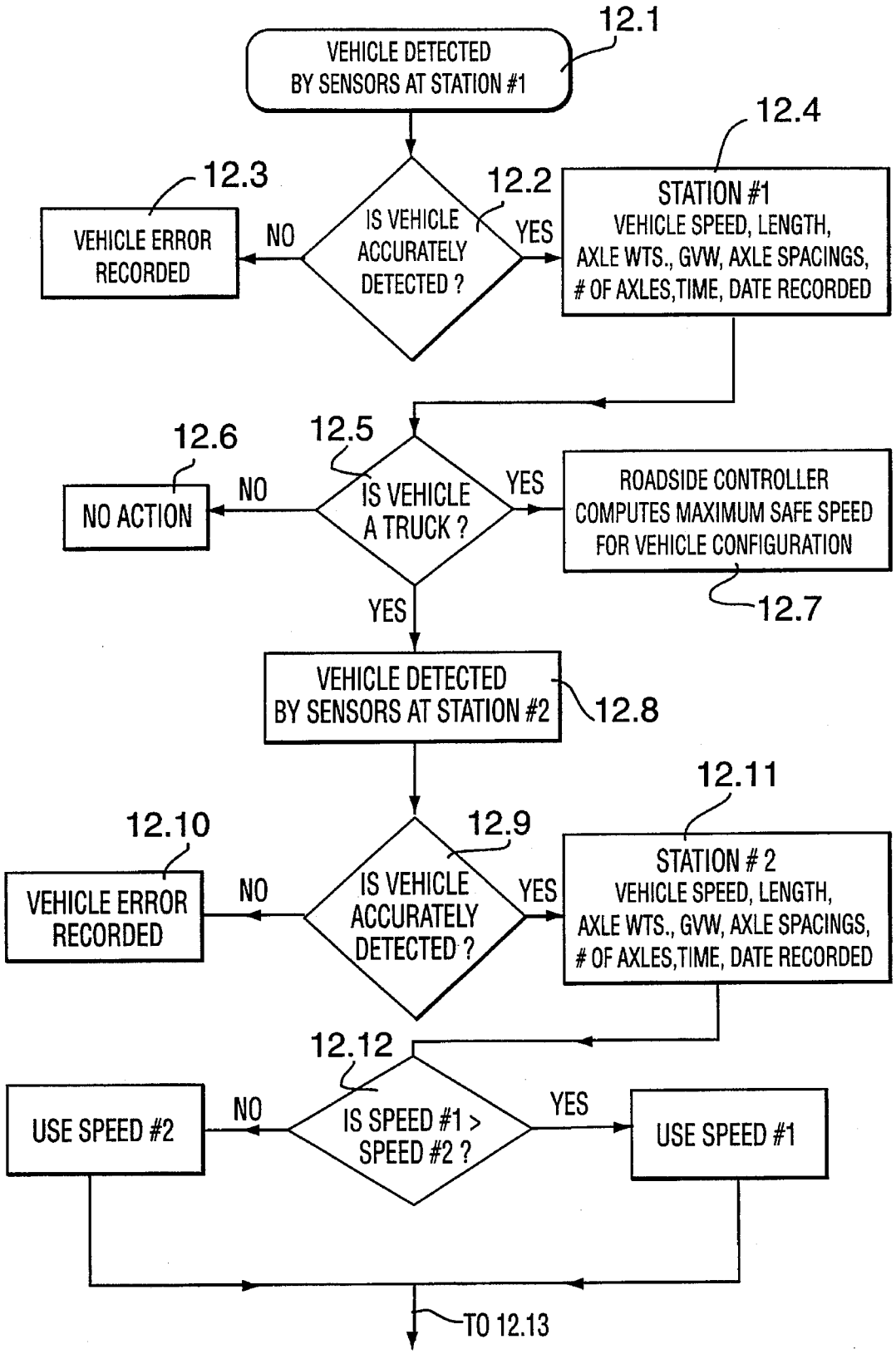
FIG. 12 is a flowchart depicting operation of the system of FIGS. 9 and 10.
Figure 12B:
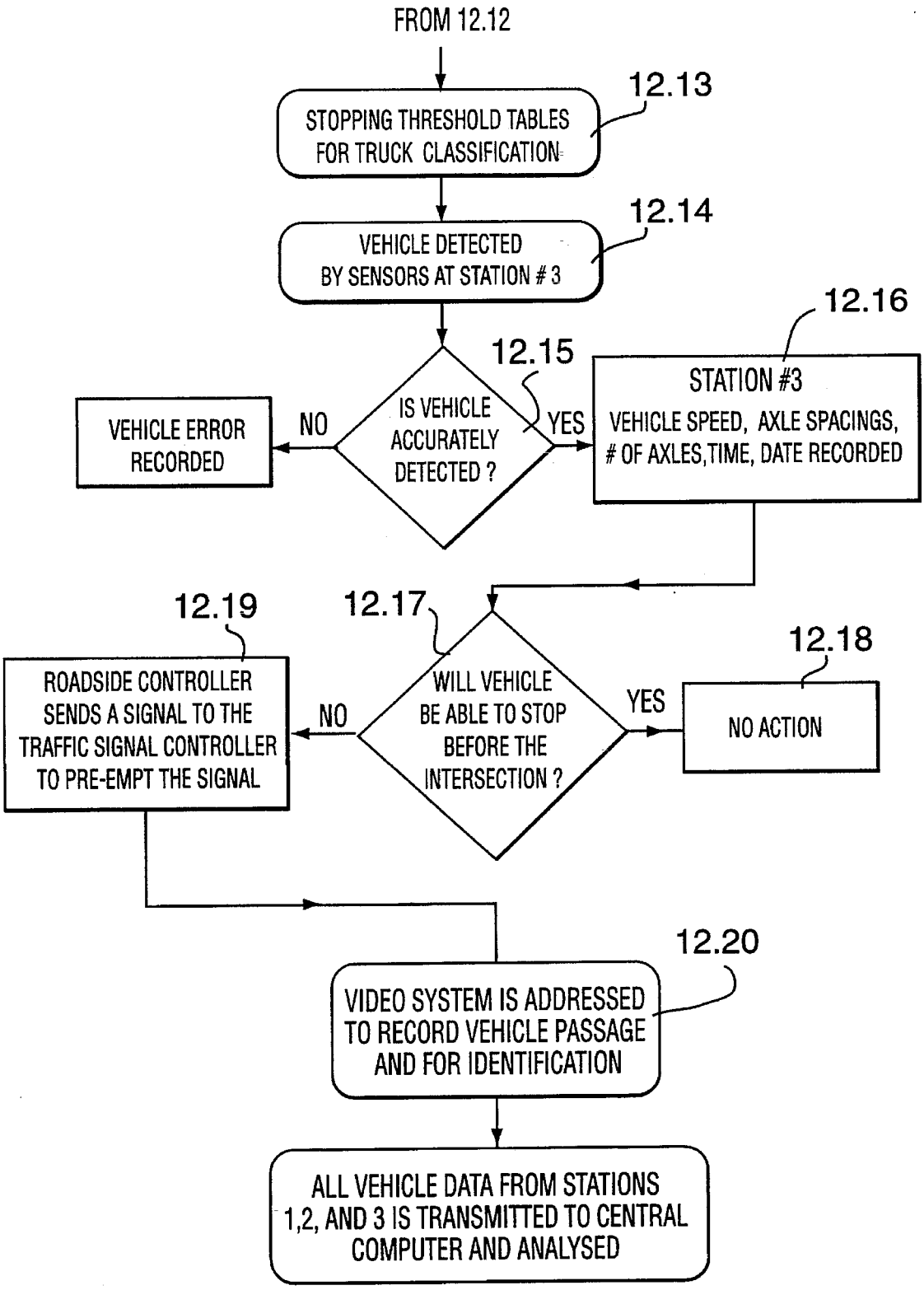

The specific sequence of operations is illustrated in FIG. 12. On receipt of a signal from the first sensor array 95, the processor determines, in steps 12.1 and 12.2, whether or not a vehicle has been accurately detected. If not, step 12.3 records an error. If the vehicle has been accurately detected, the processor processes the signals from sensor 95, in step 12.4, to compute vehicle speed, bumper to bumper length, axle weights, gross vehicle weight, axle spacings and number of axles and adds the time and date to the data before recording it. If the controller has problems processing any of the signals from the sensors in the sensor array, a warning or error is added to the vehicle information to indicate that the calculated values may be in error. From the vehicle information, the processor uses stored data or lookup tables to determine vehicle type, based upon the number of axles and the distance between each axle. From this classification, the processor determines, in decision step 12.5 whether the vehicle is a truck or not. If it is not, the processor takes no further action with the data, as indicated in step 12.6. If the vehicle data indicates that it is a truck, however, the 2processor computes, in step 12.7, a maximum safe speed for the vehicle based upon its configuration and weight.

Upon receipt of a signal from second sensor 96 in step 12.8, the processor again determines whether or not the vehicle has been accurately detected (step 12.9). If it has not, a vehicle error is recorded in step 12.10. If the controller has problems processing any of the signals from the sensors in the sensor array, a warning or error is added to the vehicle information to indicate that the calculated values may be in error. If the vehicle has been accurately detected at sensor 96, the processor processes the signals from sensor 96 in step 12.11 to determine the vehicle speed, etc. (as in 12.4). In step 12.12, it compares the actual vehicle speed measured at sensor 95 with the actual vehicle speed measured at sensor 96 and uses the greater of the two speeds in step 12.13 to obtain from tables a maximum stopping threshold for that truck classification. The stopping threshold will be based on standardized tables for each vehicle configuration.

When a signal is received from sensor array 97, the processor again checks that the vehicle has been detected accurately (steps 12.14, 12.15) and records an error if it has not. If it has, in step 12.16 the processor processes the signals from sensor 97 to produce a record of vehicle speed, axle spacings and number of axles and adds a time and date stamp as before. If the processor has problems processing any of the signals from the sensors, a warning or error is added to the vehicle information to indicate that the calculated values may be in error. Based on the stopping threshold information determined in step 12.13, and the vehicle speed measured at third sensor 97, the processor will determine in step 12.17 whether or not the truck will be able to stop before the intersection if the traffic signal requires it. If decision step 12.17 indicates that it will be able to stop, the processor takes no further action as in stop 12.18. However, if decision step 12.7 indicates that it will not be able to stop, the processor sends a signal to the traffic signal controller 100 as indicated in step 12.19, causing it to pre-empt the traffic signal to keep the traffic flowing continuously in the direction the truck is travelling. The pre-emption signal will override the traffic signal sequence either to change the traffic signal to favour the passage of the vehicle or, if it is already in its favour, to ensure that the traffic signal does not change for a suitable interval. The duration of the traffic signal pre-emption is based upon site specific geometrics and varies from site to site. The central controller can also be programmed to pre-empt the traffic signal as a precautionary measure when a warning or error occurs at any or all of the sensor arrays 95, 96 and 97.

As before, as an option to the main weighing and detection sensors, on-scale detectors may be incorporated into each lane to ensure that the vehicles passing over the in-road sensor array are fully within the active weighing zone of the system, and are not straddling a lane. The on-scale detectors effectively eliminate the possibility that a vehicle which was improperly weighed will receive a message for a speed that is higher than is safe for that particular vehicle.

It will be appreciated that there is potential for abuse, i.e. drivers deliberately causing the system to pre-empt the traffic signals. Accordingly, whenever the traffic signal controller 100 receives a pre-emption signal, it operates the roadside camera 101, as indicated by step 12.20, to capture an image of the vehicle which caused the pre-emption signal. The video record will provide a means of identifying vehicles for safety and regulatory purposes.

As in the case of the other embodiments, all vehicle data collected from sensor arrays 95, 96 and 97 can be transmitted, via modem, to a central computer fox analysis.

In any of the embodiments of the invention, the controller may be reprogrammed with fresh data and table information, conveniently by means of, for example, a laptop computer. Moreover, instead of the data being transmitted via modem to the central computer, the data could be stored in the controller's memory and retrieved periodically by, for example, a laptop computer. A remote terminal can be used to provide full remote control over the operation of the system, including controls, such as disabling the system or overriding signal pre-emption where there is a false alarm.

An advantage of traffic monitoring systems embodying the present invention is that they perform real-time computations using information specific to a particular vehicle and information specific to a particular potential hazard to determine what message, if any, to display to the driver of the vehicle or, in the case of the traffic signal pre-emption system, whether or not to pre-empt the regular traffic signal. Hence, the system recommendations are tailored to the site and the specific vehicle. Consequently, there is less likelihood of erroneous or untimely messages being displayed and hence increased likelihood that drivers will heed the messages and/or not abuse the system.

In each embodiment of the invention, the controller may also have an auto-calibration feature. If the system fails for any reason, an alert signal is transmitted to the host computer via modem, informing the system operators of a system malfunction.

Although embodiments of the invention have been described and illustrated in detail, it is to be clearly understood that they are by way of illustration and example only and not to be taken by way of the limitation, the spirit and scope of the present invention being limited only by the appended claims.

What is claimed is:

1. A traffic monitoring system comprising:

(i) a set of sensors which are disposed in a traffic lane approaching a hazard for providing signals indicative of the speed, and also indicative of at least the weight of a vehicle traversing the set of sensors;

(ii) a processor having a memory for storing site-specific dimensional data related both to the hazard and to signals from said set of sensors; and (iii) a traffic signalling device associated with said traffic lane and disposed downstream of said set of sensors, said traffic signalling device being controlled by said processor;

said processor being responsive to said signals from said set of sensors for computing a computed vehicle speed and a derived maximum vehicle speed, said derived maximum vehicle speed being derived from said site-specific dimensional data and from at least said weight of said vehicle, said derived vehicle speed being a maximum speed for said vehicle to negotiate said hazard, said processor comparing said computed vehicle speed with said derived maximum vehicle speed and operating said traffic signalling device if said computed vehicle speed exceeds said derived maximum vehicle speed.

2. A traffic monitoring system comprising:

(i) a set of sensors which are disposed in a traffic lane approaching a curve, said set of sensors comprising a set of sensor arrays for providing signals indicative of the speed of a vehicle, a vehicle weight sensor for providing signals indicative of the weight of said vehicle and a vehicle height sensor for providing signals indicative of the height of said vehicle;

(ii) a processor having a memory for storing site-specific dimensional data comprising characteristics of said curve and signals from said set of sensors; and (iii) a traffic signalling device associated with said traffic lane and disposed downstream of said sensor, said traffic signalling device being controlled by said processor;

said processor being responsive to signals from said set of sensors for computing, a predicted speed at which said vehicle will be travelling on arrival at said curve, and for deriving a derived maximum speed for said vehicle to negotiate said curve safely on the basis of said vehicle weight as determined by said vehicle weight sensor and said vehicle height as determined by said vehicle height sensor, said processor comparing said predicted vehicle speed with said derived maximum vehicle speed, and operating said traffic signalling device if said predicted vehicle speed exceeds said derived maximum vehicle speed, to display a warning to a driver of said vehicle if said predicted speed exceeds said derived maximum speed.

3. A traffic monitoring system comprising:

(i) a set of sensors spaced-apart along a traffic lane approaching a downgrade, said set of sensors providing signals indicative of the speed of vehicle, and a sensor for providing signals indicative of at least the weight of said vehicle;

(ii) a processor having a memory for storing site-specific dimensional data related both to said downgrade including the length and severity of said downgrade and to signals from said set of sensors; and (iii) a traffic signalling device associated with said traffic lane and disposed downstream of said set of sensors, said traffic signalling device comprising a message sign, said message sign being controlled by said processor;

said processor being responsive to said signals from said set of sensors for computing a computed vehicle speed and for deriving a derived maximum vehicle speed which is derived from said site-specific dimensional data and from at least said weight of said vehicle, said derived vehicle speed being a maximum speed for said vehicle to descend said downgrade, said processor by comparing said computed vehicle speed with said derived maximum vehicle speed and operating said traffic signalling device if said computed vehicle speed exceeds said derived maximum vehicle speed by transmitting a control signal to said message sign, thereby causing said message sign to display said maximum speed for a period of time during which said sign is visible to a driver of said vehicle.

4. A system as claimed in claim 3, further comprising a downstream vehicle presence detector situated downstream of said message sign, said vehicle presence detector being connected to said processor, said processor being responsive to a signal from said downstream vehicle presence detector for terminating display of said maximum speed.

5. A traffic monitoring system for use in association with a traffic-signal-controlled section having a set of traffic signals and a traffic signal controller, said traffic monitoring system comprising:

(i) a plurality of sensors disposed in a traffic lane upstream of said traffic-signal controlled intersection, said plurality of sensors comprising a preceding sensor which is disposed a predetermined distance in advance of said intersection and a final sensor downstream from said preceding sensor in the direction of traffic flow for providing signals indicative of the speed of a vehicle, and a further sensor which senses weight of said vehicle for providing signals indicative of the weight of said vehicle; and (ii) a processor having a memory for storing site-specific dimensional data including said predetermined distance, said processor being responsive to said signals from said vehicle weight sensor, from said preceding sensor and from said final sensor to compute predicted vehicle speed at said final sensor and being responsive to signals from said site-specific dimensional data to determine whether or not said predicted vehicle speed exceeds a derived maximum speed from which said vehicle can safely stop at said intersection should said traffic signals require it, said processor transmitting a pre-emption signal to said traffic signal controller thereby causing said traffic signal controller to switch said traffic signal, or to maintain said traffic signal to afford right-or-way through said intersection to said vehicle.

6. A traffic monitoring system as claimed in claim 5, wherein said preceding sensor comprises first and second sensor arrays spaced-apart along said traffic lane; and wherein said processor is responsive to said data and signals from said first and second sensors arrays for computing said maximum speed and responsive to signals from said final sensor for determining actual vehicle speed at said final sensor.

7. A traffic monitoring system as claimed in claim 5 further comprising a camera device which is actuable in dependence upon said pre-emption signal to capture an image of a vehicle causing said pre-emption signal.

8. A traffic monitoring system as claimed in claim 7, further comprising a vehicle presence detector downstream of said traffic signal for generating a signal, when traversed by said vehicle, for deactivating said camera device.

9. A method of analyzing data from any of the systems as claimed in claims 1 to 8 inclusive, including the steps of: downloading a set of records of vehicle parameters and associated speeds derived from a set of sensors which are disposed upstream of said hazard; downloading a set of records for corresponding vehicle parameters and speeds derived from a set of sensors which are disposed downstream of said hazard; matching vehicle records from both sets; and comparing the vehicle speed measured before said hard with the vehicle speed measured after said traffic signalling device.

* * * * *